US006440193B1

(12) United States Patent
Johansen et al.

(10) Patent No.: US 6,440,193 B1
(45) Date of Patent: Aug. 27, 2002

(54) METHOD AND REACTOR FOR PRODUCTION OF ALUMINUM BY CARBOTHERMIC REDUCTION OF ALUMINA

(75) Inventors: Kai Johansen, Kristiansand; Jan A. Aune, Langhus, both of (NO)

(73) Assignees: Alcoa Inc., Pittsburgh, PA (US); Elken ASA, Oslo (NO)

( * ) Notice: Subject to any disclaimer, the term of this patent is extended or adjusted under 35 U.S.C. 154(b) by 0 days.

(21) Appl. No.: 09/862,192

(22) Filed: May 21, 2001

Related U.S. Application Data

(63) Continuation of application No. PCT/US01/16449, filed on May 21, 2001.

(51) Int. Cl.[7] ..... C22B 21/02

(52) U.S. Cl. ..... 75/10.27; 75/412; 75/674; 266/160; 266/176; 373/86; 420/580; 420/590

(58) Field of Search ..... 75/10.27, 412, 75/674; 266/160, 176; 373/86; 420/580, 590

(56) References Cited

U.S. PATENT DOCUMENTS

| | | | | |
|---|---|---|---|---|
| 2,974,032 A | | 3/1961 | Grunert et al. | |
| 3,721,546 A | * | 3/1973 | Shiba et al. | 75/10.27 |
| 4,099,959 A | | 7/1978 | Dewing et al. | |
| 4,213,599 A | * | 7/1980 | Dewing et al. | 266/166 |
| 4,486,229 A | | 12/1984 | Troup et al. | |
| 4,491,472 A | | 1/1985 | Stevenson et al. | |
| 4,734,130 A | * | 3/1988 | Adam et al. | 75/10.27 |

OTHER PUBLICATIONS

Aluminum Company of America, *Aluminum*, vol. III, *Carbothermic Aluminum, American Society for Metals*, 1967, pp. 18–36, US.

Kai Johansen et al., *Carbothermic Aluminum, Sixth International Conference on Molten Slags, Fluxes and Salts*, Jun. 12–17, 2000.

* cited by examiner

*Primary Examiner*—Melvyn Andrews
(74) *Attorney, Agent, or Firm*—Daniel P. Cillo; Glenn E. Klepac

(57) ABSTRACT

The present invention relates to a process for carbothermic production of aluminum where molten bath aluminum carbide and aluminum oxide are produced in a low temperature compartment (2), and continuously flow into a high temperature compartment (3) where the aluminum carbide is reacted with alumina to produce a top aluminum layer (31), where the aluminum layer (31) forms a layer on the top of a molten slag layer and is tapped from the high temperature compartment (3) at outlet (5), and where off-gases from the two compartments are treated in reactors fed by one or more columns (9, 19). According to the invention the low temperature compartment (2) and the high temperature compartment (3) are located in a common reaction vessel (1) where the low temperature compartment is separated from the high temperature compartment by an underflow partition wall (4). The present invention also includes precipitating and filtering aluminum carbide from the tapped molten aluminum, followed by degassing and casting to form aluminum shapes such as ingots (62). The present invention further relates to a reactor for production of aluminum by carbothermic reduction of aluminum.

16 Claims, 1 Drawing Sheet

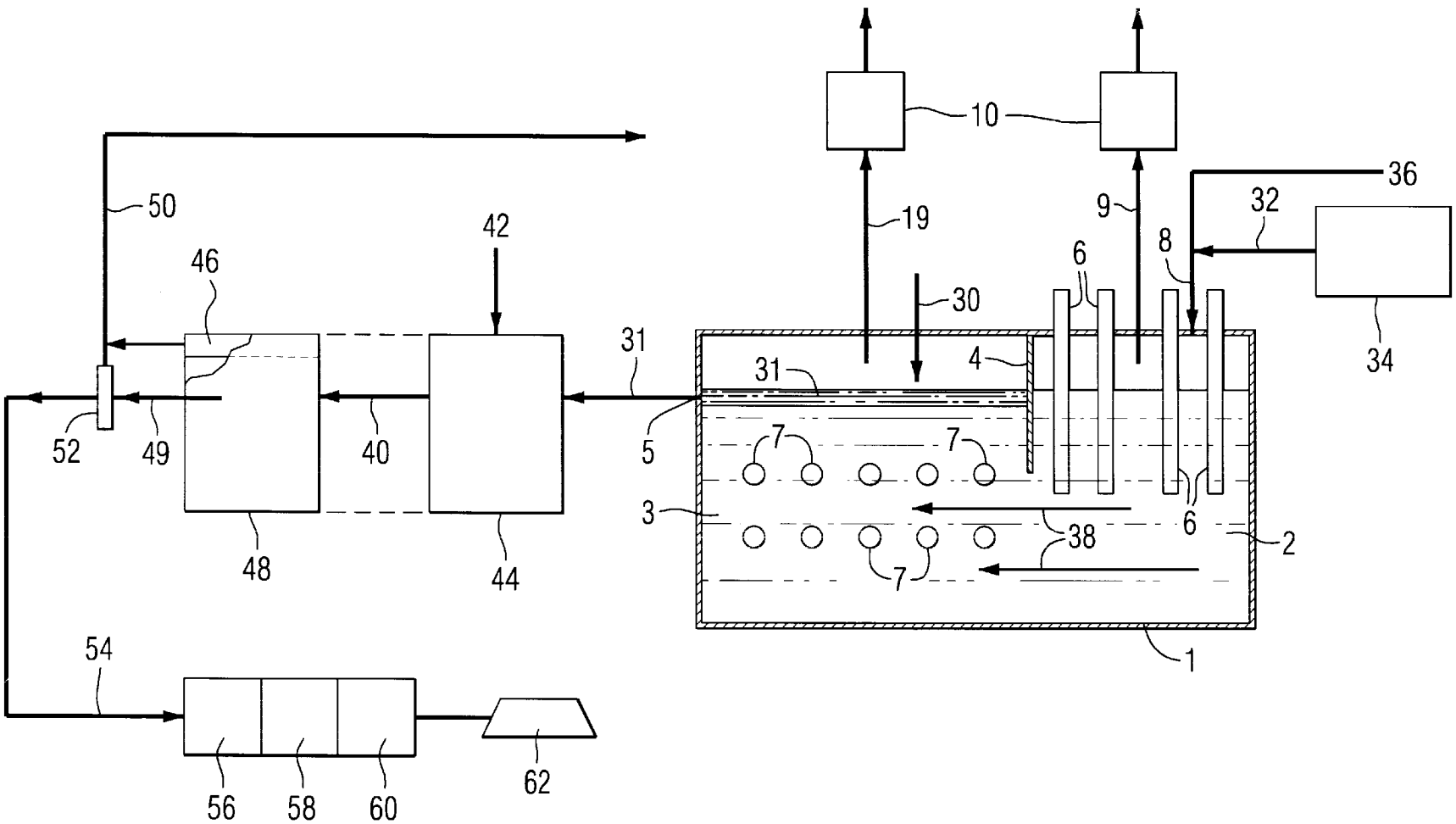
36
34
32
2
8
6
1
9
6
38
10
4
30
7
19
7
31
7
5
3
31
42
44
62
40
60
58
48
46
56
50
49
54
52

METHOD AND REACTOR FOR PRODUCTION OF ALUMINUM BY CARBOTHERMIC REDUCTION OF ALUMINA

CROSS-REFERENCE TO RELATED APPLICATION

This application is a continuation of PCT/US01/16449 filed May 21, 2001.

FIELD OF THE INVENTION

The present invention relates to a process for the production of aluminum by carbothermic reduction of alumina and to a reactor for the production of aluminum by reduction of alumina.

BACKGROUND OF THE INVENTION

The direct carbothermic reduction of alumina has been described in U.S. Pat. No. 2,974,032 (Grunert et al.) and it has long been recognized that the overall reaction $$Al_2O_3+3C=2Al+3CO \quad (1)$$

takes place, or can be made to take place, in two steps:

$$2Al_2O_3+9C=Al_4C_3+6CO \quad (2) \text{ and,}$$

$$Al_4C_3+Al_2O_3=6Al+3CO \quad (3).$$

Reaction (2) takes place at temperatures below 2000° C. and generally between 1900 and 2000° C. Reaction (3), which is the aluminum producing reaction, takes place at appreciably higher temperatures of 2200° C. and above; the reaction rate increases with increasing temperature. In addition to the species stated in reactions (2) and (3), volatile species including gaseous Al, gaseous aluminum suboxide, that is $Al_2O$, and CO are formed in reactions (2) and (3) and are carried away with the off gas. Unless recovered, these volatile species will represent a loss in the yield of aluminum. Both reactions (2) and (3) are endothermic.

Other patents relating to carbothermic reduction to produce aluminum include U.S. Pat. Nos. 4,486,229 and 4,491,472 (Troup et al. and Stevenson et al.) Dual reaction zones are described in U.S. Pat. No. 4,099,959 (Dewing et al.). There, an $Al_2O_3$–$Al_4C_3$ phase diagram shows the conditions of temperature and composition for Grunert et al. reaction (5) to proceed at one atmosphere. Dewing et al. shows a variety of apparatus to produce aluminum where generally, the energy driving the reactions is supplied by resistance heating of slag in transit from a low temperature zone to a high temperature zone. Dewing et al. states that in most instances in his invention the aluminum-liberating reaction is carried out in an upwardly inclined passage and gas evolved is employed to achieve circulatory movement of the slag. There, molten slag of $Al_2O_3$+$Al_4C_3$ is generally continually recirculated.

SUMMARY OF THE INVENTION

The present invention relates to a process for carbothermic production of aluminum where aluminum carbide is produced together with molten aluminum oxide in a low temperature compartment. The molten bath of aluminum carbide and aluminum oxide flows into a high temperature compartment, where the aluminum carbide, that is $Al_4C_3$, is reacted with the aluminum oxide, that is $Al_2O_3$, to produce aluminum. The aluminum forms a layer on the top of a molten slag layer and is tapped from the high temperature compartment. The off-gases from the low temperature compartment and from the high temperature compartment, which contain Al vapor and volatile $Al_2O$, that is aluminum suboxide, are reacted to form $Al_4C_3$. In the present invention, the low temperature compartment and the high temperature compartment are located in a common reaction vessel, with the low temperature compartment being separated from the high temperature compartment by an underflow partition wall. The molten bath containing aluminum carbide and aluminum oxide produced in the low temperature compartment continuously flows under the partition wall and into the high temperature compartment by means of gravity flow which is regulated by tapping of aluminum in the high temperature compartment. The energy needed to maintain the temperature in the low temperature compartment and in the high temperature compartment is provided by separate energy supply systems.

According to a preferred embodiment, the energy necessary to maintain the temperature in the low temperature compartment can be provided by means of high intensity resistance heating such as through electrodes submerged into the molten bath of aluminum carbide and aluminum oxide.

Similarly, the energy necessary to maintain the temperature in the high temperature compartment can be provided by a plurality of pairs of electrodes arranged in the sidewalls of that compartment of the reaction vessel.

According to yet another embodiment of the present process, the off- gases from the low temperature compartment and from the high temperature compartment are reacted to form $Al_4C_3$ which can be recycled.

The present invention further relates to a reactor for carbothermic production of aluminum, comprising a reaction vessel with a low temperature reaction compartment and a high temperature reaction compartment separated by a partition wall allowing underflow of molten bath from the low temperature reaction compartment to the high temperature compartment; a means for supplying alumina and a carbonaceous reduction material to the low temperature reaction compartment; a means for supplying alumina, aluminum carbide and/or carbon to the slag bath in the high temperature compartment; a means for supplying electric operating current independently to each of the low temperature reaction compartment and high temperature reaction compartment; and an over/underflow outlet for continuously tapping molten aluminum from the high temperature compartment.

Preferably, the means for supplying electric current to the low temperature reaction compartment is one or more electrodes that will effect the melting and reacting of the carbonaceous reduction material and the alumina; the electrode(s) are intended to be submerged in the molten bath in the low temperature compartment. More preferably, the electrodes in the low temperature compartment are graphite electrodes.

The means for supplying electric current to the high temperature reaction compartment is preferably a plurality of pairs of substantially horizontally arranged electrodes arranged in the sidewalls of that compartment; the electrodes will provide the heat necessary to produce aluminum, which will float to the top of the slag layer in the high temperature compartment.

According to a preferred embodiment, the reaction vessel has a substantially rectangular shape. Those portions of the reaction vessel, such as the bottom and the sidewalls, that are intended to be in contact with molten slag can be built up from a plurality of hot media-cooled panels that contain a "frozen" slag layer on their sides facing the inside of the reaction vessel.

The present invention provides molten aluminum containing aluminum carbide, about 20 wt. % to 35 wt. %, and also includes cooling tapped molten aluminum to precipitate the aluminum carbide, followed by filtering, degassing and casting to form aluminum ingots.

Thus, the present process and apparatus provide a compact reaction vessel where the low temperature compartment and the high temperature compartment are integrated in one reaction vessel. In this manner, a "once-through" process and apparatus are provided.

The present invention offers numerous advantages over the art. By injecting aluminum carbide and/or carbon into the high temperature compartment it is not necessary to return molten alumina slag from the high temperature compartment to the low temperature compartment.

The use of a plurality of pairs of sidewall electrodes in the high temperature compartment ensures that an even temperature is obtained in the slag in that compartment; this in turn results in a fast production of aluminum in the whole bath and avoidance of local superheating of the bath which would increase the amount of Al vapor and of volatile $Al_2O$. Also, the side electrodes are below the molten aluminum layer rather than passing through it. This avoids/reduces localized superheating and resulting volatilization, and is an important part of the reactor design.

The aluminum tapped from the high temperature compartment is typically saturated with aluminum carbide and may thus contain between about 20 and about 35 percent by weight of aluminum carbide. By cooling the superheated aluminum tapped from the high temperature compartment, a major part of aluminum carbide contained in the aluminum will precipitate and can be skimmed off from the molten aluminum. This aluminum carbide is preferably recycled to the high temperature compartment. The remaining aluminum carbide contained in the molten aluminum after cooling to a temperature just above the liquidous temperature of the aluminum is recovered in a conventional way, such as by filtering of the molten aluminum.

BRIEF DESCRIPTION OF THE DRAWINGS

The FIGURE is a cross-sectional view of a preferred embodiment of the reactor vessel and system according to the present invention.

DETAILED DESCRIPTION OF PREFERRED EMBODIMENTS

The FIGURE shows a generally rectangular-shaped gas tight reaction vessel 1 divided into a low temperature compartment 2 and a high temperature compartment 3 by means of an underflow partition wall 4 that allows flow of a molten bath from the low temperature compartment 2 to the high temperature compartment 3. At the end of the high temperature compartment 3 opposite the low temperature compartment 2 there is arranged an outlet 5 for tapping or removing a layer of molten aluminum 31. The molten bath flows from the low temperature compartment 2 to the high temperature compartment 3 by gravity. The flow is effected and regulated by the tapping of aluminum 31 at outlet 5. When aluminum is tapped from the high temperature compartment, a corresponding amount of molten bath flows under the partition wall from the low temperature compartment to the high temperature compartment. The two compartments are not connected by separate ducting.

In the low temperature compartment 2 there is arranged a plurality of electrodes 6, usually 2 to 4, extending through the roof of the reaction vessel 1. The electrodes 6 are, during the operation of the reaction vessel 1, intended to pass through the bath and to be submerged in the molten bath in the low temperature compartment 2 to supply energy by resistance heating. The electrodes 6 have conventional means (not shown) for supply of electric current and conventional means (not shown) for regulating the electrodes 6. The electrodes 6 are preferably consumable graphite electrodes, although any other material suitable for such use can also be employed.

In the high temperature compartment 3 there are arranged a plurality of pairs of electrodes 7 along the sidewalls of the reaction vessel 1. In the FIGURE, the side view electrodes are depicted as circles as they protrude from one wall and so only one electrode of each set is shown. The electrodes 7 can be consumable graphite electrodes or non-consumable inert electrodes. Each pair of electrodes 7 is individually supplied with electric current. By using a plurality of pair of electrodes 7 in the sidewall of the reaction vessel an even temperature is reached in the molten bath in the high temperature compartment 3. As shown, the electrodes 7 do not pass through the top of the bath and are disposed below the level of the aluminum layer 31, providing advantages described previously. In the roof of the low temperature compartment 2 there is arranged supply means 8 for supply of alumina 32 from hopper 34 and carbonaceous reduction material 36 to the low temperature compartment 2. The supply means 8 are preferably gas tight so that raw materials can be supplied without the escape of reactor off-gases through the supply means 8.

Over the roof in the low temperature compartment 2 there is further arranged a first gas exit 9. The gas exit 9 can pass to reactor 10 to recover $Al_4C_3$.

Over the roof in the high temperature compartment 3 there is arranged a second gas exit 19 which is identical to the gas exit 9 arranged on the roof over the low temperature compartment 2. Off-gases from the high temperature compartment 3 can pass to another reactor 10 to recover $Al_4C_3$. Gases flowing through exits 9 and 19 could also both pass through the same reactor 10.

A preferred embodiment providing an example for carrying out the process according to the present invention will now be described in connection with FIG. 1. A charge of alumina and carbon is supplied through the supply means 8 to the low temperature compartment 2. Electric energy is supplied through the electrodes 6 to provide and maintain a molten slag bath of alumina and $Al_4C_3$ at a temperature of about 2000° C. The electrodes 6 are submerged in the molten slag bath whereby the energy is transferred to the molten slag bath by resistance heating. The off gas from the low temperature compartment 2, which usually will contain CO, $Al_2O$ and some Al vapor, is withdrawn through an off gas duct and into the lower part of the off gas exit 9.

The molten slag consisting of aluminum carbide and alumina produced in the low temperature compartment 2 will continuously flow under the partition wall 4 and into the high temperature compartment 3. In the high temperature compartment 3 the temperature of the molten slag is increased to 2200° C. or more by supply of electric current to the plurality of sidewall electrodes 7, which heat the slag bath by resistance heating. By using a plurality of pairs of electrodes 7 arranged along the sidewalls of the high temperature compartment 3, below rather than through molten aluminum layer 31, very importantly, a substantially uniform temperature is obtained in the slag bath in the high temperature compartment 3, and localized superheating is reduced or avoided. This process involves essentially horizontal flow of the molten slag into high temperature compartment 3, as shown by the arrows 38 in compartment 2, without need of a separate heating duct or use of gasses to effect slag flow.

By maintaining the temperature in the slag bath in the high temperature compartment 3 at a temperature above about 2200° C., aluminum carbide will react with alumina to produce Al and CO gas. Due to the high temperature, an appreciable amount of produced Al will vaporize together with $Al_2O$ and will leave the furnace with the off gas. The liquid Al produced in the high temperature compartment 3 will, due to its low density, form a molten layer 31 on the top of the molten slag bottom layer and it is tapped from the furnace through the overflow outlet 5. There is no need to recirculate the remaining slag back into the low temperature compartment compartment 2 by separate ducting, saving substantial costs and simplifying the process. During the reaction of aluminum carbide and alumina, the molten slag bath in the high temperature compartment will be depleted of aluminum carbide. Additional aluminum carbide containing material is therefore injected or otherwise supplied to the high temperature compartment 3 through at least one supply means 30 arranged in the roof of the high temperature compartment 3. In addition to aluminum carbide, solid alumina and/or carbon can be charged to the high temperature compartment 3 through supply means 30.

The aluminum produced in the high temperature compartment 3 will be saturated with molten aluminum carbide. The superheated aluminum in the high temperature compartment 3 is continuously tapped through the over/underflow outlet 5 and can be passed to downstream operations. The aluminum is then cooled to form a stream 40, preferably by addition of aluminum scrap 42 in cooling vessel 44, to a temperature above the melting point for aluminum. When the aluminum is cooled a major part of the aluminum carbide dissolved in the aluminum will precipitate as solid aluminum carbide 46 and can be skimmed off from the cooled molten aluminum in purification vessel 48. Vessels 44 and 48 can be combined. The remaining aluminum carbide 50 can be removed by conventional means, such as by passing stream 49 through filter 52. The aluminum carbide removed from the aluminum after tapping is preferably recycled to the low temperature compartment 2 and/or to the high temperature compartment 3. The cooling vessel, purification vessel and filter may be of any type useful to perform its function.

The purified aluminum stream 54 may then be passed to any number of apparatus, for example, degassing apparatus 56 to remove, for example, $H_2$, fluxing apparatus 58 to scavage oxides from the melt and eventually to casting apparatus 60 to provide unalloyed primary shapes such as ingots 62 or the like of about 50 lb. (22.7 Kg) to 750 lb. (341 Kg). These ingots may then be remelted for final alloying in a holding or blending furnace or the melt from fluxing apparatus may be directly passed to a furnace for final alloying and casting as alloyed aluminum shapes. Elements such as Cu, Fe, Si, Mg, Ni, Cr, etc. may be added to the blending furnace as rich alloy ingots such as 82% Al, 18% Cu since addition in pure form may not be feasible. These operations are well Know, and described, for example, in *Aluminum*, Vol. III, Ed. Kent R. Van Horn, Amer. Soc. of Metals (1967), pp. 18–36, herein incorporated by reference.

Whereas particular embodiments of this invention have been described above for purposes of illustration, it will be evident to those skilled in the art that numerous variations of the details of the present invention may be made without departing from the invention as defined in the appended claims.

Having described the presently preferred embodiments, it is to be understood that the invention may be otherwise embodied within the scope of the appended claims.

What is claimed is:

1. A process for carbothermic production of aluminum where a molten bath comprising aluminum carbide and aluminum oxide is produced in a low temperature compartment, which molten bath of aluminum carbide and aluminum oxide flows into a high temperature compartment where the aluminum carbide is reacted with alumina to produce aluminum which forms a layer on the top of a molten slag bottom layer and said aluminum is tapped from the high temperature compartment; wherein the low temperature compartment and the high temperature compartment are located in a common reaction vessel and the low temperature compartment is separated from the high temperature compartment by an underflow partition wall; the molten bath of aluminum carbide and aluminum oxide produced in the low temperature compartment continuously flows under the partition wall and into the high temperature compartment where the molten bath produced in the low temperature compartment flows into the high temperature compartment by gravity flow effected by tapping the top aluminum layer in the high temperature compartment, and where energy needed to heat the low temperature compartment and the high temperature compartment is provided by separate energy supply means.

2. The process according to claim 1, wherein the energy supply means in the low temperature compartment is provided by high intensity resistance heating by electrodes submerged into the molten bath of aluminum carbide and aluminum oxide.

3. The process according to claim 1, wherein the energy supply means in the high temperature compartment is provided by a plurality of pairs of electrodes arranged in the sidewalls of the high temperature compartment of the reaction vessel, where said electrodes are below the molten aluminum layer rather than passing through it.

4. The process according to claim 1, wherein the off-gases from the low temperature compartment and from the high temperature compartment are reacted to form $Al_4C_3$.

5. The process according to claim 1, where the two compartments are not connected by separate ducting, and where the molten bath produced in the low temperature compartment flows in an essentially horizontal direction into the high temperature compartment.

6. The process according to claim 1, where the remaining slag bottom layer in the high temperature compartment is not recirculated back to the low temperature compartment by separate ducting.

7. The process according to claim 1, where the tapped aluminum contains small quantities of aluminum carbide, where the aluminum carbide is precipitated and the purified aluminum is alloyed and then cast into alloyed aluminum shapes.

8. The process according to claim 1, where the tapped aluminum contains small quantities of aluminum carbide, and where said tapped aluminum is cooled to precipitate the aluminum carbide, followed by filtering, degassing, and then casting in an ingot casting machine to form aluminum shapes.

9. A reactor for carbothermic production of aluminum, comprising a reaction vessel comprising a low temperature reaction compartment having means for supply of materials to said compartment and one or more electrodes for supplying electric operating current to said compartment, said electrode or electrodes being positioned for submersion in a molten bath in the low temperature compartment;

a high temperature reaction compartment being separated from the low temperature compartment by means of a partition wall allowing underflow of any formed molten bath from the low temperature reaction compartment into the high temperature compartment;

a plurality of pairs of substantially horizontally arranged electrodes arranged in the sidewall of the high temperature compartment of the reaction vessel for supply of electric current to said compartment;

means for injecting material into the high temperature compartment;

an outlet for continuously tapping molten aluminum from the high temperature compartment; and where a molten bath produced in the low temperature compartment flows into the high temperature compartment by gravity flow effected by taping the top aluminum layer in the high temperature compartment.

10. The reactor according to claim 9, wherein the reaction vessel has a substantially rectangular shape, and where the electrodes in the high temperature compartment are placed below the level where an aluminum layer would form.

11. The reactor according to claim 9, wherein the part of the bottom and the sidewalls of the reaction vessel which is intended to be in contact with molten slag is built from a plurality of hot media-cooled panels.

12. The reactor according to claim 9, wherein the electrodes in the low temperature compartment are graphite electrodes.

13. The reactor according to claim 9, wherein the one or more off-gas reactors are connected to the reactor compartments for producing $Al_4C_3$.

14. The reactor according to claim 13 further comprising means for supplying the $Al_4C_3$ to the high temperature compartment and/or to the low temperature compartment.

15. The reactor according to claim 9, wherein the two reaction compartments are not connected by separate ducting, and where any flow into the high temperature compartment is in an essentially horizontal direction.

16. The reactor according to claim 9, connected to downstream components comprising a cooling vessel for precipitating impurities in the aluminum, a degassing vessel and an ingot casting machine.

* * * * *

UNITED STATES PATENT AND TRADEMARK OFFICE

CERTIFICATE OF CORRECTION

PATENT NO. : 6,440,193 B1
DATED : August 27, 2002
INVENTOR(S) : Kai Johansen

It is certified that error appears in the above-identified patent and that said Letters Patent is hereby corrected as shown below:

Column 1,
Lines 11-14, please insert the following:

-- Statement Regarding Federally Funded Research

The subject matter of this application was made with United States Government support under Contract No. DE-FC07-001D13900 awarded by the Department of Energy. The United States Government has certain rights to this invention. --

Signed and Sealed this

Tenth Day of June, 2003

JAMES E. ROGAN
*Director of the United States Patent and Trademark Office*